US005806876A

United States Patent [19]

Alden

[11] Patent Number: 5,806,876

[45] **Date of Patent: *Sep. 15, 1998**

[54] STRAPLESS BOOT BINDING FOR SNOWBOARDS

[75] Inventor: Richard P. Alden, Morrison, Colo.

[73] Assignee: Device Manufacturing Corporation, Boulder, Colo.

[ * ] Notice: The term of this patent shall not extend beyond the expiration date of Pat. No. 5,660,410.

[21] Appl. No.: 780,414

[22] Filed: Jan. 7, 1997

Related U.S. Application Data

[63] Continuation of Ser. No. 397,670, Mar. 2, 1995, Pat. No. 5,660,410, and a continuation-in-part of Ser. No. 352,368, Dec. 9, 1994, abandoned.

[51] Int. Cl.[6] ..... A63C 9/18

[52] U.S. Cl. ..... 280/627; 280/613; 280/617; 280/14.2

[58] Field of Search ..... 280/613, 614, 280/618, 626, 631, 627, 14.2, 617

[56] References Cited

U.S. PATENT DOCUMENTS

| | | | |
|---|---|---|---|
| Re. 33,544 | 2/1991 | Dennis | 280/618 |
| D. 357,296 | 4/1995 | Sims | D21/230 |
| D. 365,132 | 12/1995 | Sims | D21/230 |
| 3,003,777 | 10/1961 | Hilding | 280/614 |
| 3,689,096 | 9/1972 | Ribi | 280/613 |
| 3,771,806 | 11/1973 | Hinterholzer et al. | 280/613 D |
| 3,785,668 | 1/1974 | Marker | 280/613 |
| 3,825,274 | 7/1974 | Weinstein | 280/623 |
| 3,838,866 | 10/1974 | D'Alessio et al. | 280/11.35 K |
| 3,936,062 | 2/1976 | Schweizer | 280/613 |
| 3,985,371 | 10/1976 | Pyzel et al. | 280/614 |
| 4,036,510 | 7/1977 | D'Alessio et al. | 280/613 |
| 4,067,593 | 1/1978 | Earl | 280/617 |
| 4,088,342 | 5/1978 | Hausleithner | 280/614 |
| 4,176,856 | 12/1979 | Glaser | 280/636 X |
| 4,352,508 | 10/1982 | Spademan | 280/624 |
| 4,353,574 | 10/1982 | Faulin | 280/613 |
| 4,358,131 | 11/1982 | Schwartz | 280/623 |
| 4,471,550 | 9/1984 | Dennis | 280/618 |
| 4,512,594 | 4/1985 | Eyre | 280/614 |
| 4,550,929 | 11/1985 | Buel | 280/614 |
| 4,632,419 | 12/1986 | Zoor | 280/614 |
| 4,856,808 | 8/1989 | Longoni | 280/617 |
| 4,973,073 | 11/1990 | Raines et al. | 280/624 |
| 4,979,760 | 12/1990 | Derrah | 280/607 |
| 5,028,068 | 7/1991 | Donovan | 280/618 |
| 5,035,443 | 7/1991 | Kincheloe | 280/618 |
| 5,044,656 | 9/1991 | Peyre | 280/618 |
| 5,054,807 | 10/1991 | Fauvet | 280/607 |
| 5,069,463 | 12/1991 | Baud et al. | 280/14.2 |
| 5,085,455 | 2/1992 | Bogner et al. | 280/618 |
| 5,094,470 | 3/1992 | Riedel | 280/607 |
| 5,143,396 | 9/1992 | Shaanan et al. | 280/607 |
| 5,261,689 | 11/1993 | Carpenter et al. | 280/618 |
| 5,299,823 | 4/1994 | Glaser | 280/625 |

(List continued on next page.)

FOREIGN PATENT DOCUMENTS

| | | | |
|---|---|---|---|
| 0105011 | 4/1984 | European Pat. Off. | A63C 9/086 |
| 2643277 | 8/1990 | France | A63C 9/18 |
| 2652753 | 4/1991 | France | 280/14.2 |
| 4018276 | 9/1991 | Germany | 280/14.2 |
| 4311630 | 2/1995 | Germany | A63C 9/08 |
| 678397 | 9/1991 | Switzerland | 280/14.2 |
| WO95/20423 | 8/1995 | WIPO . | |
| WO95/33536 | 12/1995 | WIPO . | |

OTHER PUBLICATIONS

Transworld SNOWboard Business, vol. 6, No. 5, Mar. 1995.

*Primary Examiner*—Brian L. Johnson
*Assistant Examiner*—Michael Mar
*Attorney, Agent, or Firm*—Douglas W. Swartz; Sheridan Ross P.C.

[57] ABSTRACT

A step-in, strapless snowboard binding. The snowboard binding is particularly useful for soft-shelled boots. The snowboard binding includes a receiving member and a locking member which rotate relative to one another to lock or unlock the boot relative to the binding.

17 Claims, 7 Drawing Sheets

U.S. PATENT DOCUMENTS

| | | | |
|---|---|---|---|
| 5,344,179 | 9/1994 | Fritschi et al. | 280/618 |
| 5,354,088 | 10/1994 | Vetter et al. | 280/618 |
| 5,356,170 | 10/1994 | Carpenter et al. | 280/618 |
| 5,401,041 | 3/1995 | Jespersen | 280/14.2 |
| 5,409,244 | 4/1995 | Young | 280/14.2 |
| 5,417,443 | 5/1995 | Blattner et al. | 280/14.2 |
| 5,474,322 | 12/1995 | Perkins et al. | 280/613 |
| 5,480,176 | 1/1996 | Sims | 280/618 |
| 5,499,461 | 3/1996 | Danezin et al. | 36/117 |
| 5,503,900 | 4/1996 | Fletcher | 428/160 |
| 5,505,477 | 4/1996 | Turner et al. | 280/613 |
| 5,505,478 | 4/1996 | Napoliello | 280/618 |
| 5,520,405 | 5/1996 | Bourke | 280/613 |
| 5,520,406 | 5/1996 | Anderson et al. | 280/624 |
| 5,544,909 | 8/1996 | Laughlin et al. | 280/14.2 X |

STRAPLESS BOOT BINDING FOR SNOWBOARDS

The present application is a continuation of U.S. patent application Ser. No. 08/397,670 for "Strapless Boot Binding For Snowboards" filed on Mar. 2, 1995, now U.S. Pat. No. 5,660,410 and a continuation-in-part of U.S. patent application Ser. No. 08/352,368 for "RPA Strapless, Step-In, Snowboard Boot & Binding System" filed Dec. 9, 1994, now abandoned incorporated herein by this reference in its entirety.

FIELD OF THE INVENTION

The present invention relates generally to bindings for snowboards and more specifically to strapless, step-in boot bindings for snowboards.

BACKGROUND OF THE INVENTION

Snowboarding has become a popular winter sport. In snowboarding, bindings secure a snowboarder's boots to a snowboard. A snowboard is a monolithic board, similar to a surfboard. Snowboarders generally prefer soft-shelled boots over hard-shelled boots, such as ski-boots, as they provide a greater freedom of movement. The soft-shelled boots are typically secured to the binding by one or more adjustable retaining straps extending over the top of the boot. A snowboarder connects the retaining straps by sitting down in the snow and bending over and ratcheting the straps tightly over the top of the boot. Because of the substantial length of conventional ski bindings which causes the bindings to extend over one or more sides of the snowboard, releasable bindings such as those used in skiing, have been found to be generally unsuitable for snowboarding.

The unique configuration of the snowboard creates many problems in mounting and dismounting chair lifts. To mount a chair, a snowboarder must bend over, disengage a leg from the binding and use the free leg to push himself into position in front of the chair. Retaining straps frequently become brittle and break from being repeatedly engaged and disengaged and/or from accidental contact with skiers or other snowboarders in the lift line. Unlike skiers, snowboarders cannot use poles to push themselves into a position to mount the chair.

Additional problems arise when the snowboarder turns or stops on the ski slope. During turns, the restraining straps can bunch up at the ankle, creating pain and discomfort. If the snowboarder stops on the slope, particularly for shallow declines, the snowboarder generally must push himself with a free leg to a steeper incline and then lean over and secure the free leg in the binding by connecting the retaining straps. Securing the free foot in the binding, is an extremely inconvenient procedure.

SUMMARY OF THE INVENTION

It is an objective of the present invention to provide a binding that does not require retaining straps to secure the boot to the binding. It is a related objective to provide a step-in binding.

It is a further objective to provide a binding for soft-shelled or hard-shelled boots that is easy to disengage from the boots. It is a related objective to provide a binding for soft-shelled or hard-shelled boots that has a quick, manual release capability. "Manual Release" refers to the disengagement of the boot from the binding by hand.

It is a further objective to provide a binding that is not automatically releasable from the snowboard upon impact.

These and other objectives are realized by the present invention. In a first embodiment, the present invention provides a snowboard binding system including: (i) a front member; (ii) a device on said front member for engaging the front portion of a boot; (iii) a rear member; and (iv) a device on the rear member for holding the rear portion of the boot. The device for engaging the rear portion of the boot is located at least about 1.5 inches above the top surface of the snowboard to reduce the possibility of the snowboard binding system contacting the snow during edging or turning of the snowboard. The device for engaging the rear portion of the boot releasably engages a structural member on the rear portion of the boot to hold the boot in position.

The device for engaging the rear portion of the boot can include a receiving member for engaging the structural member of the boot and a locking member. The locking member engages the receiving member to lock the boot in the binding system and disengages from the receiving member to release the boot from the binding system. The receiving member and locking member are preferably rotatably engaged on the rear member of the binding system. The binding system preferably has no fasteners, such as retaining straps, located on the front of the boot. All fasteners connecting the boot to the binding system are preferably located either on the rear or bottom of the boot.

To accommodate boots of different sizes, the relative positions of the front or rear members can be altered. For example, the front and rear members can be detached from one another and/or the front or rear member can slidably engage another member that is fixed to the snowboard to provide for convenient adjustment.

In another embodiment, the present invention provides a snowboard binding system having which includes: (i) a front member; (ii) a rear member (iii) a device, located on the front member for holding the front portion of the boot, and (d) a device, located on the rear member, for holding the rear portion of the boot. The device on the front member connects to a structural member on the bottom of the boot to hold the boot in position.

The structural member on the boot can be a hooked member with the open end of the hooked member facing towards the front end of the boot. The device for holding the front portion of the boot can include a rod to engage the hooked member.

In yet another embodiment, the present invention provides a snowboard binding system, including a holding member for receiving a boot, which includes (i) a front member; (ii) a rear member; (iii) a device, located on the front member, for holding the front portion of the boot; and (iv) a device, rotatably mounted on the arcuate rear member, for holding the rear portion of the boot. The device for holding the rear portion of the boot connects to a structural member of the boot. The device is located above the heel of the sole of the boot to reduce the likelihood of the binding system contacting the snow during edging or turning.

In the device on the arcuate rear member, a locking member, which rotatably can engage a receiving member to lock the boot in position and disengage from the receiving member to release the boot.

In yet another embodiment, the present invention includes a boot for engaging a snowboard binding, including: (i) a boot shell; (ii) a sole attached to the boot shell; and (iii) a projection extending from the rear of the boot shell for engaging the snowboard binding. The boot can include a hooked member on the sole for engaging the snowboard binding.

In yet another embodiment, a method is provided for engaging a boot with a snowboard binding, including the steps of: (i) first engaging a first structural member on the bottom of a boot with a restraining member on a snowboard binding; (ii) second engaging a second structural member on the boot with a receiving member on the snowboard binding; and (iii) placing the receiving member in a locked position.

The process can include additional steps, such as rotating the receiving member into a locked position and engaging the receiving member with a locking member on the snowboard binding to place the receiving member into a locked position.

To release the boot from the binding, the locking member is rotated to disengage the locking member from the receiving member and the boot is removed from the snowboard binding.

The strapless, step-in binding system of the present invention is applicable to soft-and hard-shelled boots and eliminates many of the problems in existing snowboard bindings. For example, the present invention provides for a quick and convenient method to mount and manually release a boot from a binding system, thereby facilitating mounting ski chairs and reducing pain and discomfort associated with maneuvering snowboards using existing snowboard bindings.

DETAILED DESCRIPTION

Figure 1:
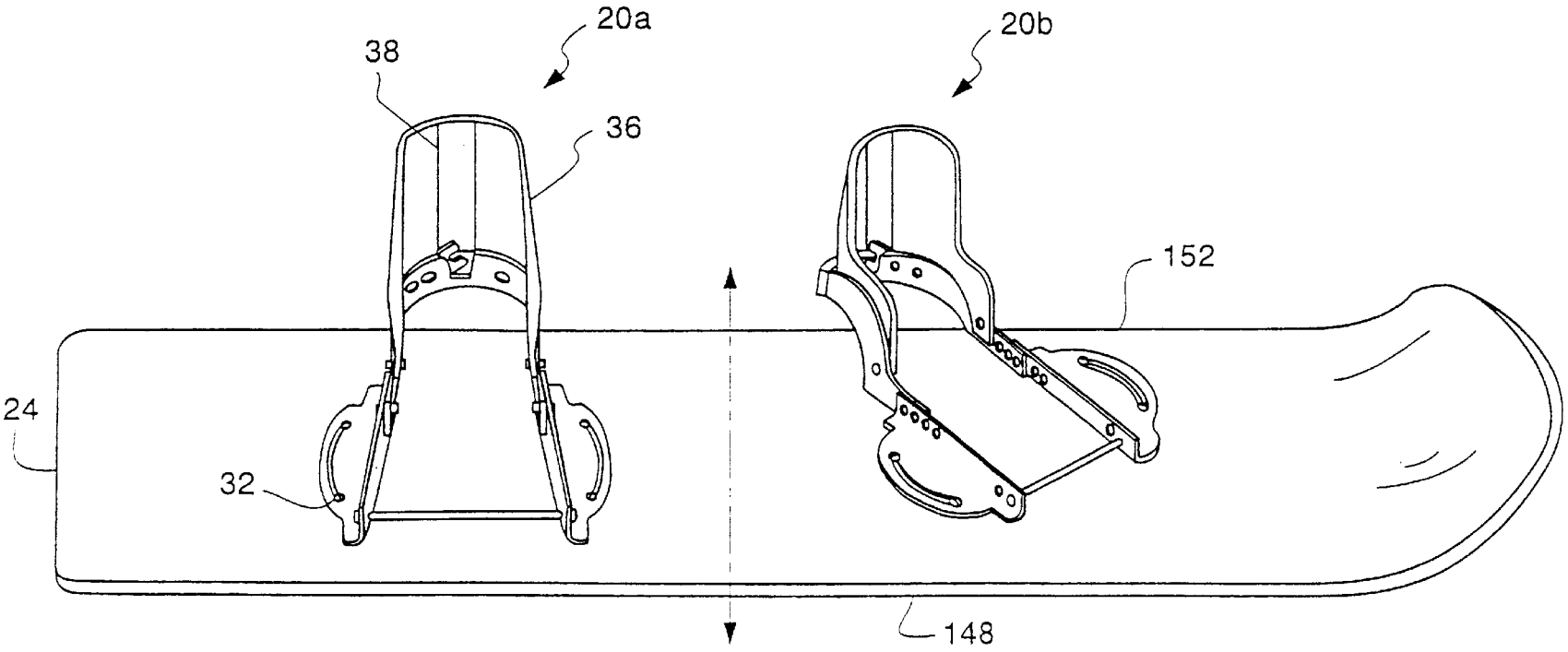
FIG. 1 is a view of an embodiment of the snowboard bindings of the present invention mounted on a snowboard.

A preferred embodiment of the present invention is illustrated in FIG. 1. Two snowboard bindings 20*a, b* are mounted at forward and rear locations on a snowboard 24. The orientation of the snowboard bindings 20*a, b* relative to the longitudinal axis of the snowboard 24 is determined by the preference of the snowboarder. Generally, the rear snowboard binding 20*a* is normal to the latitudinal axis of the snowboard and the front snowboard binding 20*b* is at an angle, less than 60 degrees relative to the snowboard axis. Because the two snowboard bindings 20*a, b* have substantially the same construction, for ease of explanation only the rear snowboard binding 20*a* will be described in detail.

Figure 2:
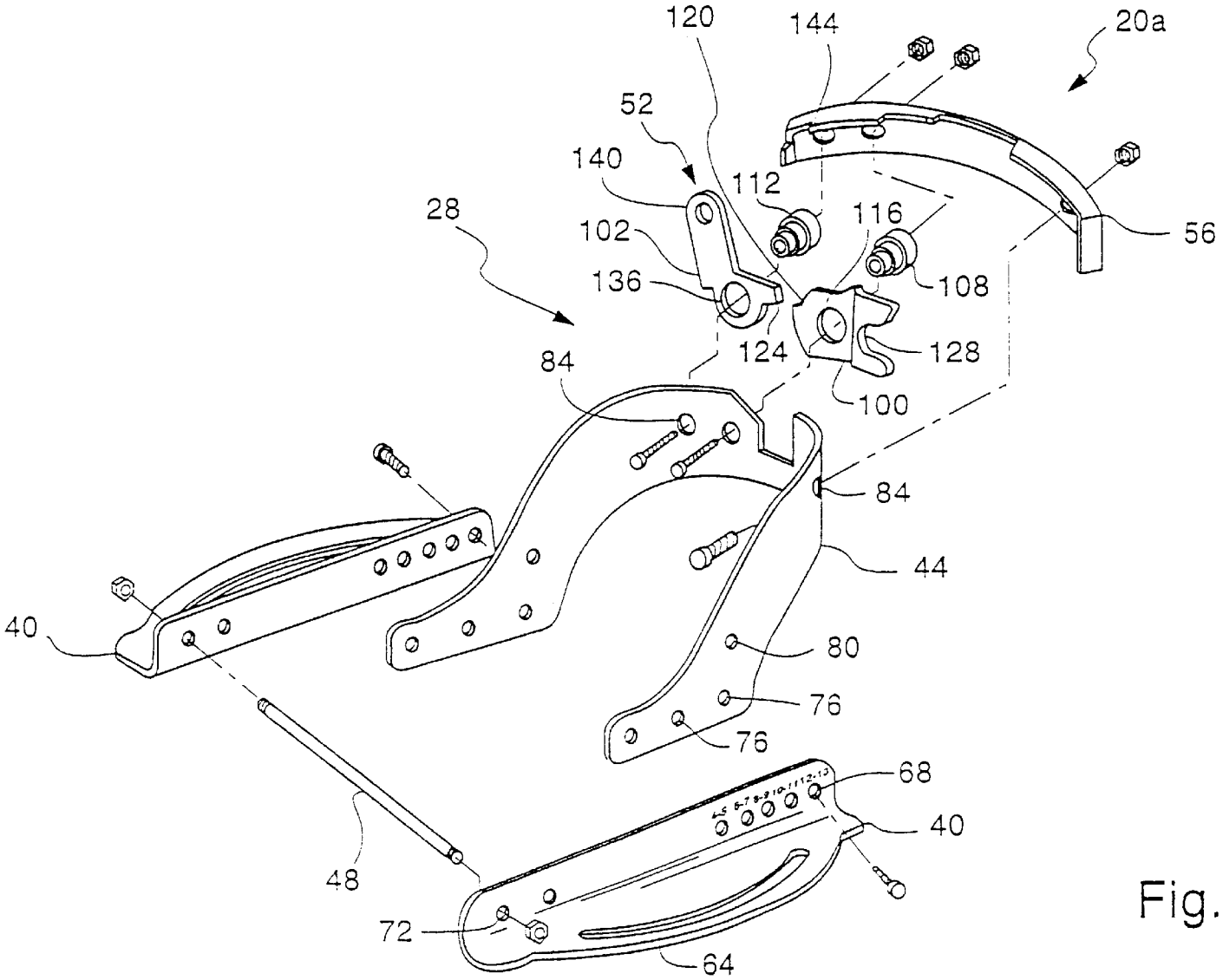
FIG. 2 is a view of the embodiment in a disassembled state.

Referring to FIGS. 1 and 2, the snowboard binding 20*a* includes a holding member assembly 28 for engaging the soft- or hard-shelled boot (not shown), binding fasteners 32 for attaching the holding member assembly 28 to the snowboard 24 (not shown in FIG. 2), and a leg support 36 for transferring forces from the leg of the snowboarder to the snowboard 24 (not shown in FIG. 2).

The holding member assembly 28 includes side members 40, an arcuate rear member 44, a restraining member 48, a locking subassembly 52, and a housing member 56. The various components are connected by screws and bolts as shown in FIG. 2 or by another suitable type of fastener.

The side members 40 are mirror images of one another. Each side member has an orientation adjustment slot 64 for adjusting the orientation of the holding member assembly 28 relative to the longitudinal axis of the snowboard 24, boot adjustment holes 68 for adjusting the holding member assembly 28 to receive a boot of a desired size, and restraining member holes 72 for receiving the restraining member 48.

The arcuate rear member 44 preferably has substantially the same shape as the rear portion of the boot. The arcuate rear member includes boot adjustment holes 76 for aligning with the boot adjustment holes 68 on the side member 40, leg support holes 80 for attaching the leg support 36 to the arcuate member 44, and housing holes 84 for attaching the locking subassembly 52 and housing member 56 to the arcuate member 44.

The rear portion of the arcuate member 44 is elevated above the top of the snowboard 24, preferably at least about 1 inch above the top of the snowboard 24, to prevent the arcuate member 44 from contacting the snow during edging or turning of the snowboard 24. Typically, snowboards are relatively narrow, having a width ranging from about 8 to about 14 inches. At such narrow widths, the contact of the front or rear of the snowboard binding and boot with the snow can be a significant problem, especially during edging or turning. To narrow the length of the binding as much as possible, the rear portion of the arcuate member 44 is elevated above the snowboard 24.

Figure 3:
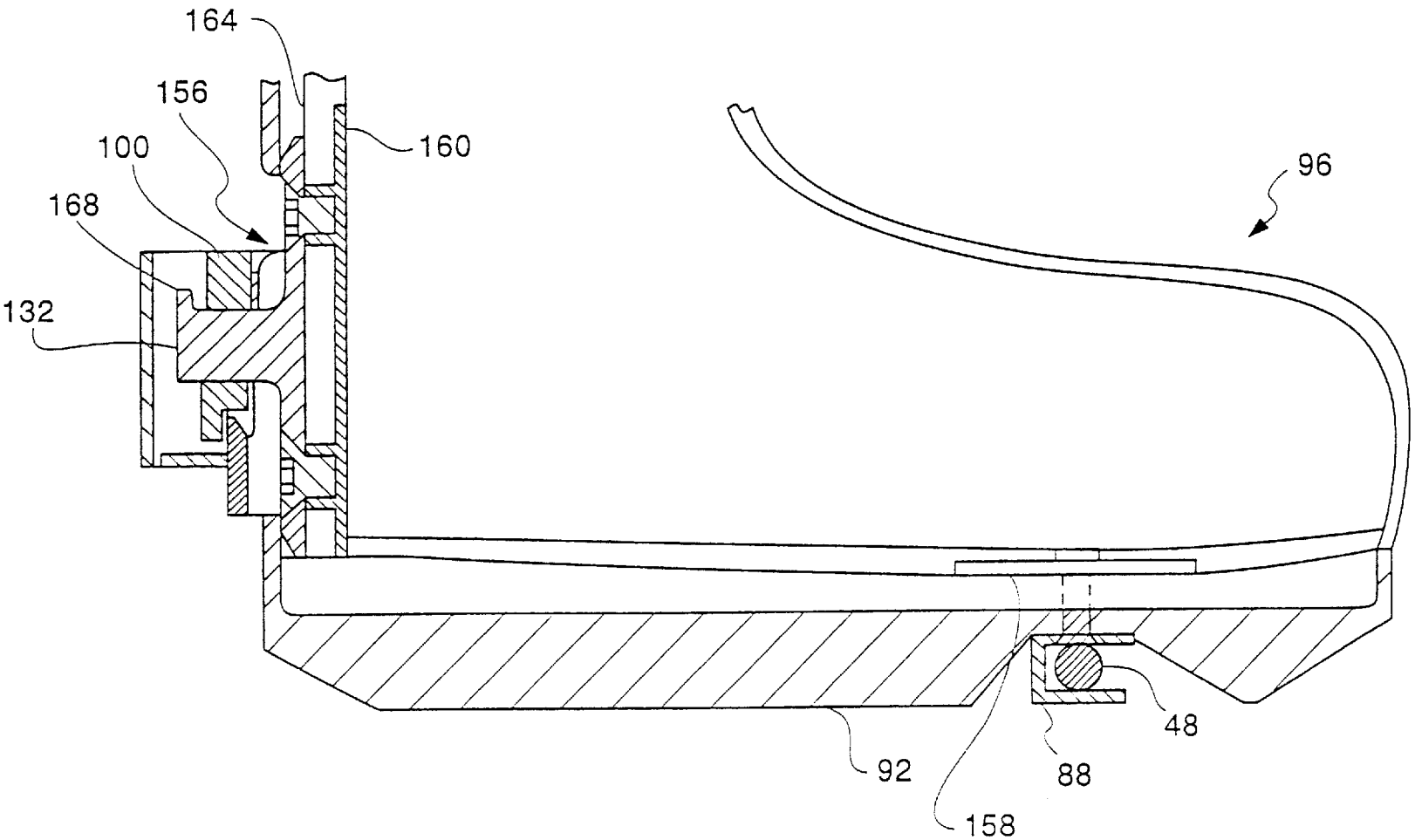
FIG. 3 is a cross-sectional view of a soft-shelled boot according to the present invention engaging the snowboard binding.

Referring to FIGS. 2 and 3, the restraining member 48 engages a hooked member 88 on the sole 92 of a boot 96 for holding the front portion of the boot in the holding member assembly 28. The restraining member 48 can be any suitable shape and size provided that the restraining member 48 interlocks with the hooked member 88. In the preferred embodiment, the restraining member 48 is rod-shaped and extends between the side members 40. As will be appreciated, the restraining member can be any other sortable device to engage the front of the boot, such as a toe clip. The restraining member 48 can be located on the snowboard 24 detached from the side members 40 to more easily accommodate different boot sizes. The holding member assembly 28 can be adjusted for a boot size simply by altering the location of the restraining member relative to the side members.

The locking subassembly 52 includes a receiving member 100, a locking member 102, receiving member bushing 108, and locking member bushing 112. The receiving member 100 has a bushing hole 116 for receiving the receiving member bushing 108, a notched end 120 to engage an extension 124 of the locking member 112, and a slotted end 128 for receiving a projection 132 in the boot 96. The locking member 102 has a bushing hole 136 for receiving the locking member bushing 112, the extension 124 to engage the notched end 120 of the receiving member 128, and a lever 140 to rotate the locking member 102 and disengage the locking member 102 from the receiving member 100. The locking member 102 and receiving member 100 rotate independently from one another to enable the locking member 102 to be engaged and disengaged from the receiving member 100 during use. As will be appreciated, the locking subassembly 52 can be a number of other suitable devices that are capable of engaging a rear structural member on the boot, such as the projection.

The locking subassembly 52 is located at the rear of the arcuate member 44 and is thereby elevated above the top of the snowboard 24. As noted above, the relatively narrow widths of the snowboard 24 impose limitations on the length of snowboard bindings. This problem is overcome by positioning the locking subassembly 52 at the rear of the arcuate member 44. In this position, the locking subassembly 52 is preferably located above the heel of the boot at a height ranging from about 1.5 to about 5 inches and more preferably from about 2 to about 5 inches above the top of the snowboard 24. The locking subassembly 52 is preferably not located too high above the top of the snowboard 24 as it would detrimentally affect the ability to control the snowboard 24 through too much flexibility in the boot.

The housing member 56 attaches to the rear of the arcuate rear member 44 and protects the locking subassembly 52 from damage. The housing member 56 includes attachment holes 144 for receiving bolts to attach the housing member 56 to the arcuate rear member 44.

The binding fasteners 32 are typically screws which pass through the adjustment slot 64 to engage the snowboard 24. As noted above, the adjustment slot 64 permits the holding member assembly 28 to be oriented at a desired angle relative to the longitudinal axis of the snowboard 24.

The leg support 36 increases the maneuverability of the snowboard 24 by enabling the snowboarder to exert forces on the snowboard. To edge and/or turn the snowboard 24, a snowboarder leans back on the leg support 36, which lifts the toe edge 148 of the snowboard. As the toe edge 148 is lifted, the heel edge 152 exerts increased force on the snow which causes the snowboard 24 to turn. The leg support 36 includes alignment slot 38 to guide the projection 132 into the locking subassembly 52. The width and depth of the alignment slot 38 is sufficient to receive the projection 132.

As will be appreciated, the leg support 36 can be in a variety of heights. Low back leg supports typically have a height ranging from about 5 to about 7 inches above the top of the snowboard 24. High back leg supports typically have a height ranging from about 7 to 11 inches above the top of the snowboard 24. Low back leg supports are typically preferred where the snowboarder desires a greater degree of movement. High back leg supports are typically preferred where the snowboarder desires a greater degree of control over the maneuverability of the snowboard. The leg support can be eliminated from the holding member assembly altogether in some applications.

Referring again to FIG. 3, the boot 96 includes the hooked member 88 located on a recessed portion of the sole 92 of the boot 96 and a projection assembly 156 on the rear of the boot 96. The hooked member 88 is recessed in the sole and extends no further than the bottom of sole to make walking in the boots easier and allow the boot to stand flat on the snowboard. The hooked member 88 is mounted on a backing plate 158 located in the lower surface of the boot shell 164 for securing the hooked member to the boot 96. Preferably, the hooked member 88 is located on the boot so that the hooked member 88 is between the middle of the snowboarder's foot and the seam of his toes. As will be appreciated, if the hooked member 88 is too close to the rear of the boot, entry into the holding member assembly is more difficult. Likewise, if the hooked member 88 is located too close to the toe of the boot, the toe of the boot may contact the snow during edging or turning. As will be appreciated, the hooked member can be replaced by a variety of other devices that are capable of engaging the holding member assembly 28. The projection assembly 156 includes the projection 132 for engaging the receiving member 100 and a backing plate 160 located inside of the boot shell 164 for securing the projection 132 to the boot 96. The projection includes a spur 168 to prevent the projection 132 from being removed from the receiving member 100 when the receiving member 100 is in a locked position. The cross-sectional area of the spur 168 is greater than the cross-sectional area of the portion of the projection in the slot on the slotted end 128 of the receiving member 100. The spur 168 also extends vertically beyond the upper edge of the slot. As will be appreciated, the projection can be replaced by a variety of other types of rear structural members on the boot that are capable of engaging the holding member assembly 28. The backing plate 160 has a radius of curvature substantially equal to the radius of curvature of the inside of the top of the boot 96. The backing plates 158, 160 have a sufficient area to prevent the hooked member 88 and projection assembly 156, respectively, from being torn out of the boot during use.

Referring again to FIG. 1, the receiving member can face the same direction in both the right and left snowboard bindings 20*a, b* to simplify construction of the bindings.

Figure 4:
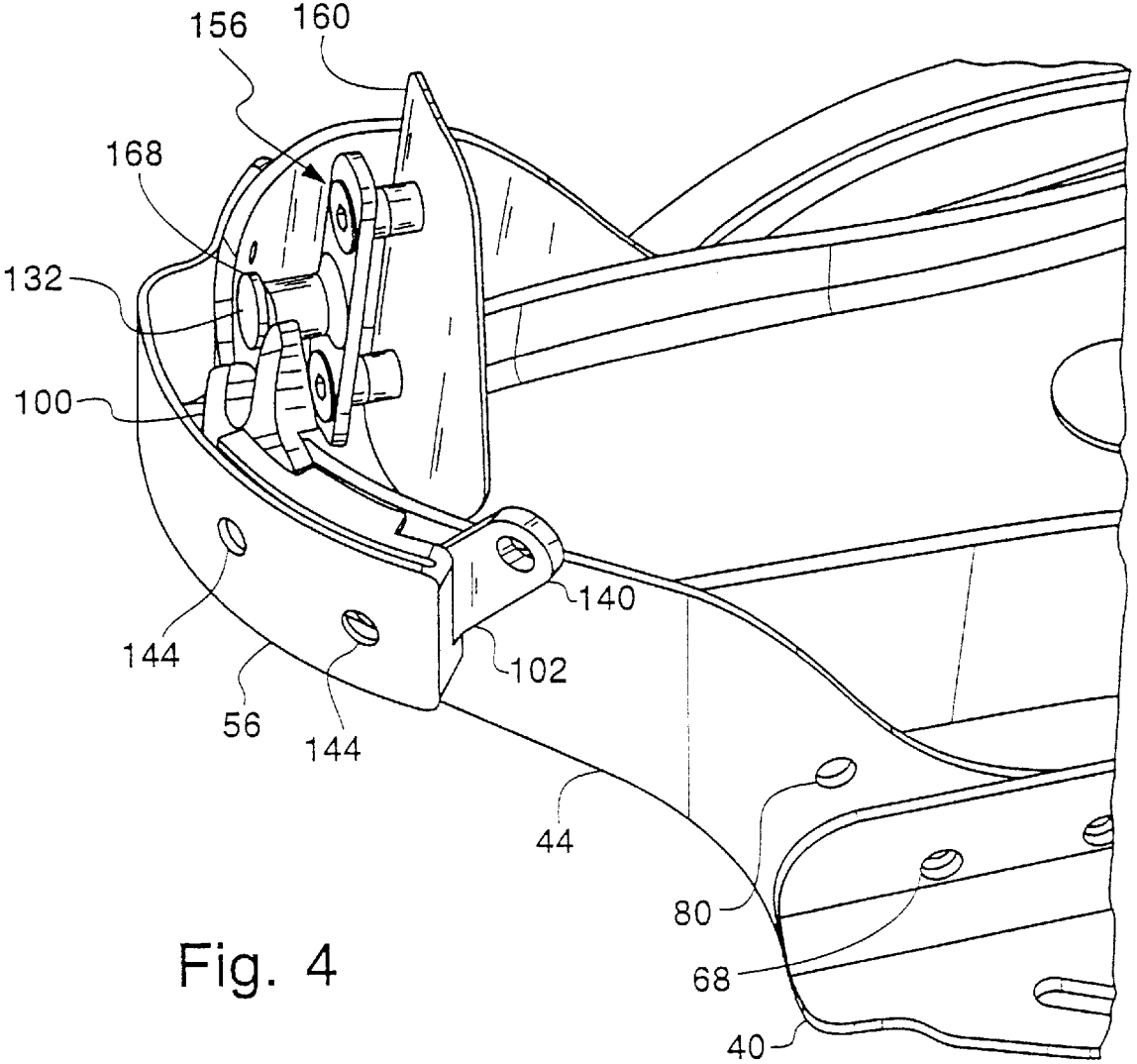
FIG. 4 is a view of the projection assembly (removed from the boot) being inserted into the receiving member.
Figure 5:
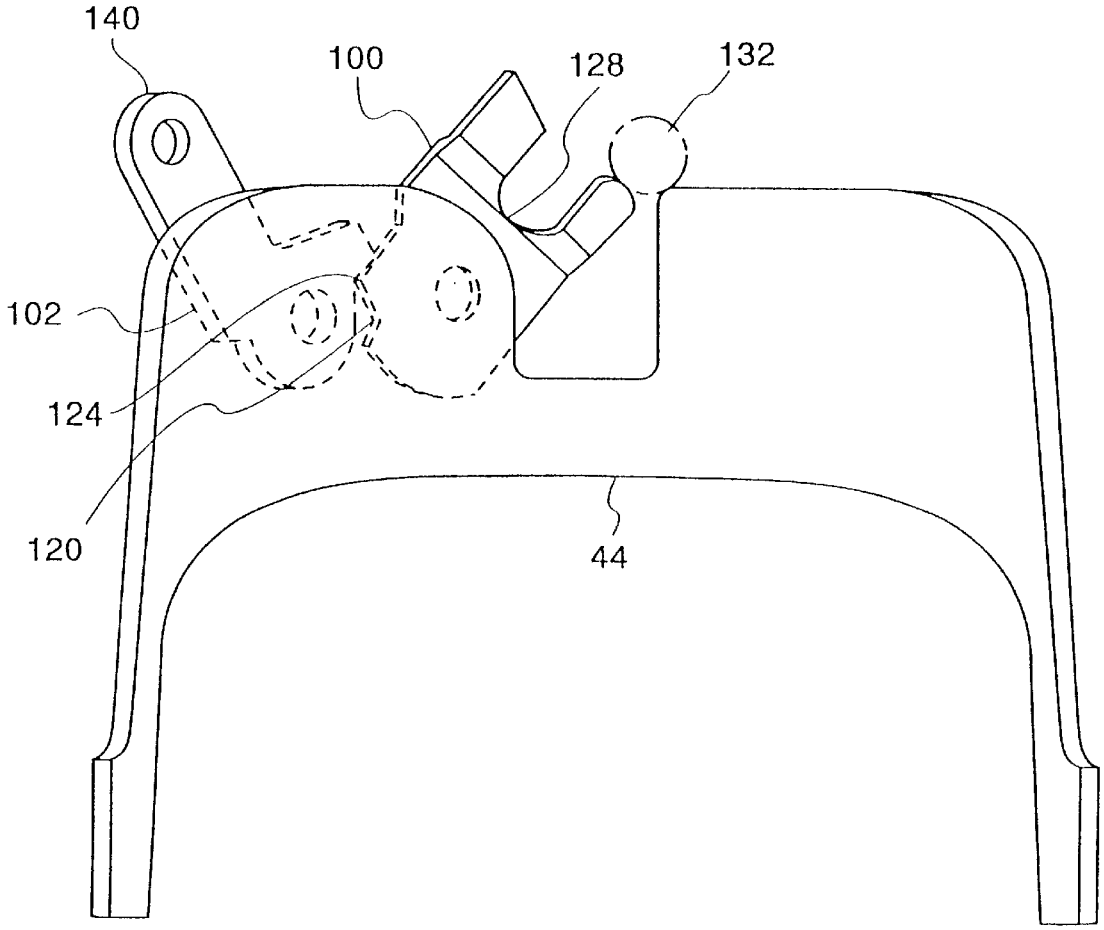
FIGS. 5–6 are views of the projection being inserted into the receiving member.
Figure 6:
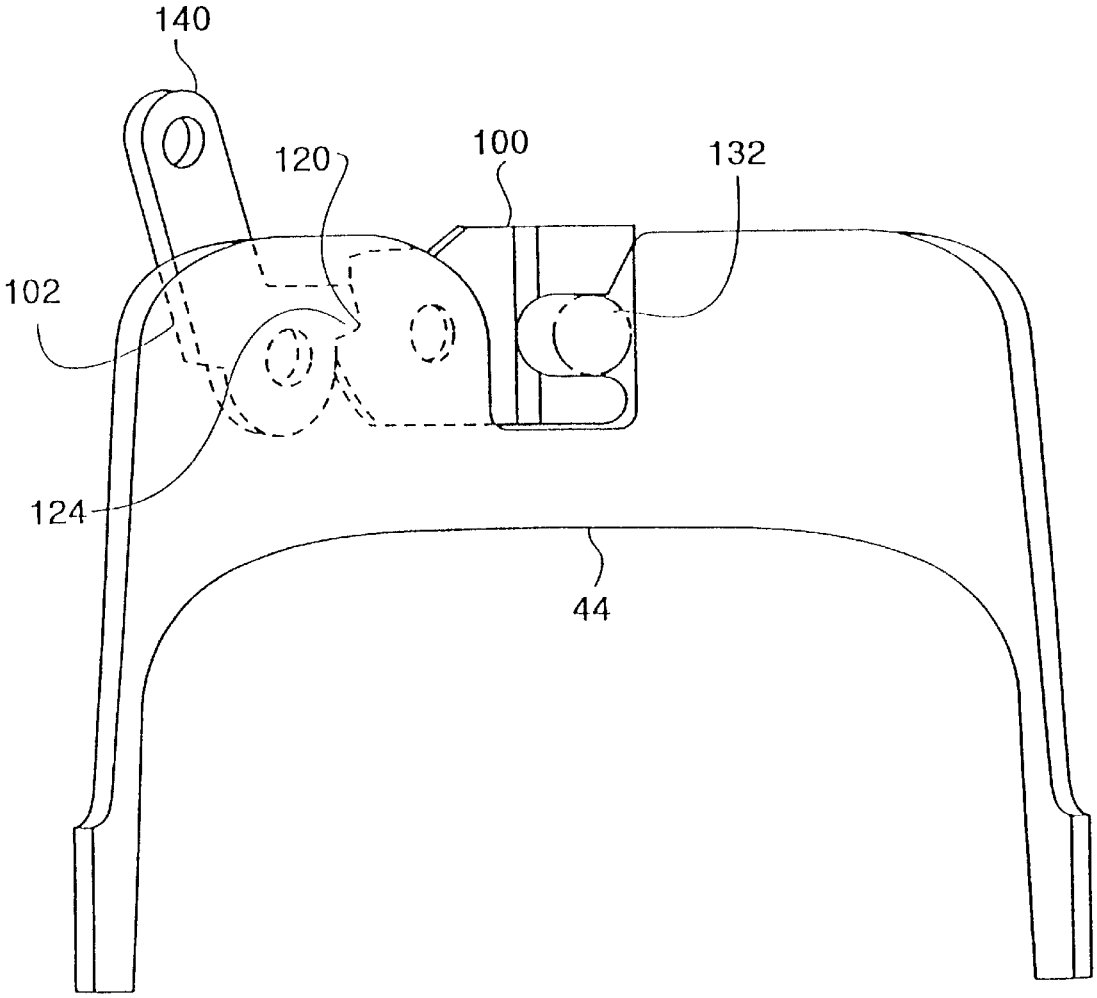

The operation of the snowboard binding 20*a* is illustrated in FIGS. 4–6. The snowboard bindings 20*a, b* are first mounted on the snowboard 24 at the desired orientations relative to the longitudinal axis of the snowboard.

After the snowboard bindings 20*a, b* are mounted on the snowboard 24, the boots 96 are sequentially placed in a locked position in the holding member assembly 28. To place the boots 96 in a locked position, the boots are engaged with the holding member assembly 28 by placing the restraining member 48 in the hooked member 88 and then placing the projection 132 into the slotted end of the receiving member 100. The boot 96 is then forced downwards towards the snowboard 24, which causes the receiving member 100 to rotate about the receiving member bushing with the slotted end moving downward. The extension 124 rotates about the locking member bushing to engage the notched end 120 to place the receiving member in the locked position.

To release the boot 96 from the holding member assembly 28, the lever 140 is moved downward to cause the locking member to rotate relative to the locking member bushing and the extension 124 to disengage from the notched end 120 of the receiving member 100. The boot is forced upward to cause the disengaged receiving member 100 to rotate upward into an unlocked position.

Figure 7:
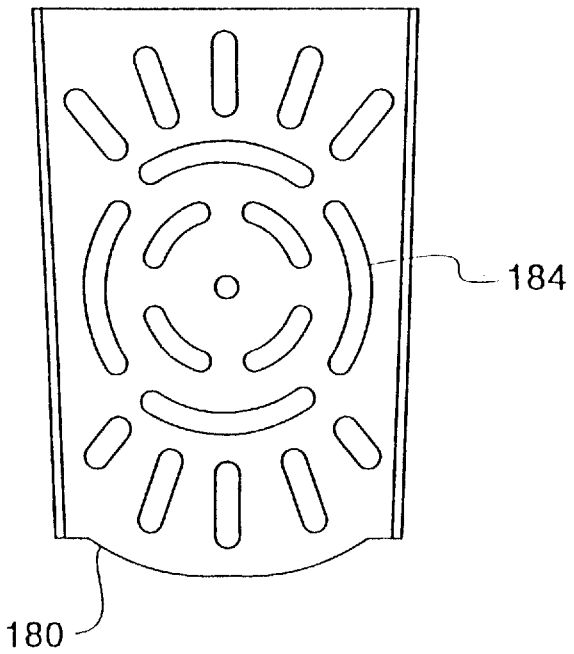
FIG. 7 is a view of another embodiment of the present invention.

An alternative embodiment is depicted in FIG. 7. FIG. 7 depicts the snowboard binding 20*a* with a solid base plate 180 rather than two separate side members 40. The base plate 180 includes orientation adjustment slots 184, boot adjustment holes, and restraining member holes.

While various embodiments of the present invention have been described in detail, it is apparent that modifications and adaptations of those embodiments will occur to those skilled in the art. It is to be expressly understood, however, that such modifications and adaptations are within the scope of the present invention, as set forth in the following claims.

What is claimed is:

1. A snowboard binding system for receiving a boot, said binding system comprising:

front and rear member for engaging a boot, the boot having a front portion, a rear portion and a structural member on the rear portion and said rear member being arcuate shaped;

means on said front member for engaging the front portion of the boot; and means on said rear member for holding the rear portion of the boot, said means for holding releasably engaging the structural member to hold the boot in position;

said means for holding the rear portion of the boot includes a receiving member having a portion for receiving and engaging the structural member, said receiving member being pivotably mounted on the rear member for movement between a release position and a locked position, and a locking member rotatably engaged on said rear member, said locking member engaging said receiving member to lock the boot in said binding system when the receiving member is in the locked position and disengaging from said receiving member to release the boot from said binding system.

2. A snowboard binding system according to claim 1, wherein said means for holding the rear portion is located at least about 1.5 inches above the surface of the snowboard.

3. A snowboard binding system for receiving a boot, said binding system comprising:

said boot having a front portion, a rear portion and a structural member on the rear portion, the structural member comprising a projection from the boot;

front and rear members for engaging the boot;

means on said front member for engaging the front portion of the boot; and means on said rear member for holding the rear portion of the boot, said means for holding releasably engaging said structural member to hold the boot in position;

said means for holding further comprising:

a receiving member having a slotted portion for receiving and engaging said projection from the boot, said receiving member being pivotably mounted on said rear member for movement between a release position and a locked position; and a locking member pivotably mounted on said rear member, said locking member engaging said receiving member to lock the boot in said binding system when the receiving member is in the locked position and disengaging from said receiving member to release the boot from said binding system.

4. A snowboard binding system according to claim 3, wherein said means for holding being located at least about 1.5 inches above the surface of the snowboard.

5. A snowboard binding system for receiving a boot in a secured position on a surface of a snowboard having a snowboard longitudinal axis between opposite side edges of said snowboard, said binding system comprising:

said boot having a front portion and a rear portion;

front and rear members for engaging the boot, said front and rear members defining a binding longitudinal axis that is substantially transverse to the snowboard longitudinal axis;

means on said front member for engaging said front portion of the boot; and means on said rear member and the rear portion for releasably holding the rear portion of the boot in a locked position, said means for releasably holding comprising:

a binding rod;

a receiving member having a portion for receiving and engaging the structural member, the receiving member portion being movably mounted on the rear member for movement between a release position and the locked position, the receiving member portion engaging said binding rod; and an upwardly opening alignment slot extending substantially vertically upward and aligned with the receiving member portion for guiding the binding rod into the receiving member portion when the receiving member portion is in the release position.

6. A snowboard binding system according to claim 5, wherein said means for releasably holding is located above a heel of the boot.

7. A snowboard binding system according to claim 5, wherein the receiving member rotatably engages the rear member.

8. A snowboard binding system for receiving a boot in a snowboarding position on a surface of a snowboard, said binding system comprising:

the boot having a front portion, a rear portion having an outer rear surface provided with a given shape, and a structural member on the rear portion, the structural member comprising a projection extending from the rear portion of the boot;

front and rear members for engaging the boot;

means on said front member for engaging the front portion of the boot; and means on said rear member for holding the rear portion of the boot, said means for holding comprising:

said rear member having a binding section provided with the given shape having an inner surface extending along the outer rear surface and an outer surface, the outer rear surface and outer surface being located on opposing sides of the inner surface, said binding section having a first slot therein for receiving said projection; and a receiving member having a second slot for engaging said projection which is received in said first slot, said receiving member being mounted on said outer surface of said binding section for rotation on said binding section to move said second slot and hold said projection in said first slot with the boot in the snowboarding position.

9. A snowboard binding according to claim 8, wherein the first and second slots are located above a heel of the boot.

10. A snowboard binding for releasably securing a back of a snowboard boot to a snowboard, said snowboard binding comprising:

a snowboard boot having a front portion and a back portion, a rod being located on the back portion;

a front binding member secured to the top surface of the snowboard, the front binding member engaging the front portion of the snowboard boot to secure the snowboard boot to the snowboard;

a back binding member secured to the top surface of the snowboard, said back binding member having a leg engagement section located above the snowboard to engage a leg of a snowboarder and a latch section located above the snowboard and below the leg engagement section to engage the rod, the latch section including a receiving member that receives and engages the rod, the receiving member being movably mounted on the latch section for movement between a release position and a locked position, wherein the log engagement section includes means for guiding the rod into the receiving member and the receiving member is aligned with the means for guiding when the receiving member is in the release position.

11. A snowboard binding according to claim 10, wherein the means for guiding includes an upwardly opening and upwardly extending alignment slot.

12. A snowboard binding according to claim 10, wherein the front and rear binding members define a binding longitudinal axis that is transverse to the longitudinal axis of the snowboard.

13. A snowboard binding system for releasably holding a snowboarder in a snowboarding position on a surface of a snowboard, the snowboard being provided with a snowboard longitudinal axis, the snowboard binding system comprising:

a boot having a toe and heel portions and front and rear binding members for engaging the boot, the front and rear binding members defining a binding longitudinal axis that is substantially transverse to the snowboard longitudinal axis, wherein the front binding member includes a fastener for releasably engaging the toe portion of the boot and the rear binding member includes (a) a receiving member having a portion for receiving and engaging a structural member on the heel portion of the boot, the receiving member being movably mounted on the rear binding member for movement between a release position and a locked position and (b) an alignment slot aligned with the receiving member, when the receiving member is in the release position, for guiding the structural member into engagement with the receiving member, whereby, in the release position, the boot is removable from the front and rear binding members and, in the locked position, the boot is lockably engaged by the front and rear binding members.

14. A snowboard binding system according to claim 13, wherein the alignment slot extends upwardly from the receiving member.

15. A snowboard binding system according to claim 14, wherein the alignment slot opens upwardly.

16. A method for engaging a snowboard boot with a snowboard binding located on a snowboard, a longitudinal axis of the snowboard being substantially transverse to a longitudinal axis of the snowboard binding, comprising:

engaging a structural member on a toe portion of the snowboard boot with an interlocking structural member on the snowboard to hold the toe portion in position on the snowboard;

passing a projection on a rear portion of the snowboard boot along a length of an upwardly extending and upwardly opening alignment slot;

receiving the projection in a receiving member movably mounted on a rear portion of the snowboard binding, the receiving member being movable between a release position and a locked position; and lockably engaging the projection with the receiving member by moving the receiving member to the locked position, the receiving member being aligned with the alignment slot when the receiving member is in the release position to guide the projection into the receiving member.

17. The method of claim 16, further comprising:

disengaging the receiving member to release the projection from the receiving member; and traversing at least a portion of the alignment slot with the projection to remove the snowboard boot from the snowboard binding.

* * * * *